US007132997B2

(12) United States Patent
Uesaka et al.

(10) Patent No.: US 7,132,997 B2
(45) Date of Patent: Nov. 7, 2006

(54) NARROW-DIRECTIVITY ELECTROMAGNETIC-FIELD ANTENNA PROBE, AND ELECTROMAGNETIC-FIELD MEASUREMENT APPARATUS, ELECTRIC-CURRENT DISTRIBUTION SEARCH-FOR APPARATUS OR ELECTRICAL-WIRING DIAGNOSIS APPARATUS USING THIS ANTENNA PROBE

(75) Inventors: Kouichi Uesaka, Kawasaki (JP); Masami Makuuchi, Yokohama (JP); Kenichi Shinbo, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/695,864

(22) Filed: Oct. 30, 2003

(65) Prior Publication Data

US 2004/0135734 A1 Jul. 15, 2004

(30) Foreign Application Priority Data

Oct. 30, 2002 (JP) ..... 2002-315229

(51) Int. Cl.
*H01Q 21/00* (2006.01)
*H01Q 11/12* (2006.01)

(52) U.S. Cl. ..... 343/867; 343/703; 343/742; 343/832

(58) Field of Classification Search ..... 343/781 R, 343/819, 833, 866, 912, 703, 742, 832, 867, 343/829, 846; 324/457, 458, 200, 244, 260, 324/76.11, 149
See application file for complete search history.

(56) References Cited

U.S. PATENT DOCUMENTS 4,010,475 A * 3/1977 James ..... 343/830
4,301,457 A * 11/1981 Bogner ..... 343/770
4,763,130 A * 8/1988 Weinstein ..... 343/770
5,523,686 A * 6/1996 Kirtley et al. ..... 324/248
5,600,243 A * 2/1997 Colclough ..... 324/248
5,940,048 A * 8/1999 Martek ..... 343/893
6,034,638 A * 3/2000 Thiel et al. ..... 343/702
6,127,987 A * 10/2000 Maruyama et al. ..... 343/835
6,369,770 B1 * 4/2002 Gothard et al. ..... 343/794
6,452,565 B1 * 9/2002 Kingsley et al. ..... 343/873
6,696,834 B1 * 2/2004 Kou et al. ..... 324/258
6,741,220 B1 * 5/2004 Inoue ..... 343/797
2002/0132581 A1 * 9/2002 Ichihara ..... 455/25
2004/0114535 A1 * 6/2004 Hoffmann et al. ..... 370/252

FOREIGN PATENT DOCUMENTS

JP 10-311857 11/1998
JP 2001-228227 8/2001

* cited by examiner

*Primary Examiner*—Tan Ho
*Assistant Examiner*—Leith Al-Nazer
(74) *Attorney, Agent, or Firm*—Antonelli, Terry, Stout and Kraus, LLP.

(57) ABSTRACT

Multiple monopole antennas or loop antennas for generating electromagnetic fields whose phases become opposite to the phase of an electromagnetic field that the conventional single monopole antenna or loop antenna generates are located in proximity to the conventional single monopole antenna or loop antenna such that the components of the electromagnetic field in directions other than a probe-desired direction will be cancelled out.

8 Claims, 15 Drawing Sheets

NARROW-DIRECTIVITY ELECTROMAGNETIC-FIELD ANTENNA PROBE, AND ELECTROMAGNETIC-FIELD MEASUREMENT APPARATUS, ELECTRIC-CURRENT DISTRIBUTION SEARCH-FOR APPARATUS OR ELECTRICAL-WIRING DIAGNOSIS APPARATUS USING THIS ANTENNA PROBE

BACKGROUND OF THE INVENTION

The present invention relates to a probe and apparatuses using this probe for measuring proximate electromagnetic fields in proximity to high-frequency operating electronic appliances, information processing terminals, communications appliances, semiconductors, circuit boards, and the like, or for irradiating these targets with an electromagnetic field.

Conventionally, a small monopole antenna or a small loop antenna has been used as the probe, thereby performing the measurement of the electromagnetic fields or the irradiation with the electromagnetic field. As a result, it has been a limit to acquire a position resolution that is almost identical to a measurement height or an irradiation height, i.e., a spacing between a target to be measured and the probe.

In JP-A-2001-255347, the conventional proximate electromagnetic-field measuring probe has been disclosed as follows: In order to shield extraneous noises, it is selected as an object to provide a proximate electromagnetic-field measuring antenna having unidirectionality. Moreover, in order to accomplish this object, the antenna is designed to be a one whose directionality is formed into the unidirectionality by equipping the antenna with a metallic horn or a dielectric. This design makes the directionality unidirectional in the aperture direction of the metallic horn. Also, the existence of this metallic horn shields the extraneous noises. Accordingly, it becomes possible to measure only a desired electromagnetic field.

SUMMARY OF THE INVENTION

When using the conventional small monopole antenna or the conventional small loop antenna as the probe, the half-width of the probe is equal to substantially 90° and, considering the parallel component with a target to be measured, the half-width becomes equal to substantially 45°. Accordingly, the measurement-position resolution becomes almost identical to the measurement height, since the probe height and the half-width become regions that are almost identical to each other. On account of this, there has existed the following problem: Unless the probe height is lowered by bringing the probe extremely closer to the to-be-measured target, it is impossible to wish the implementation of enhancing the measurement-position resolution up to a higher resolution.

Also, in the antenna disclosed in JP-A-2001-255347, the electric-current direction flowing in the main device and the electric-current direction flowing in the shield unit are in a mutually orthogonal relationship. As a result, the antenna exhibits an effect of shielding the main device from an electric field arriving thereat from a side above the shield-unit's lower surface. The antenna, however, has canceled out radiation electric-field components radiated toward a side below the shield-unit's lower surface, thereby finding it impossible to narrow the directionality. Consequently, there has existed the following problem: It is impossible to narrow, down to smaller than, the directionality of a radiation electric field radiated from the main device to the probe's lower portion.

In order to solve the above-described problems, it is required to narrow the directionality of the probe using the small monopole antenna or the small loop antenna. This makes it possible to acquire the position resolution that is higher than the probe height. For implementing this requirement, it is selected as an object to narrow the directionality of the small monopole antenna or that of the small loop antenna.

Other objects, features and advantages of the invention will become apparent from the following description of the embodiments of the invention taken in conjunction with the accompanying drawings.

DETAILED DESCRIPTION OF THE EMBODIMENTS

Figure 1:
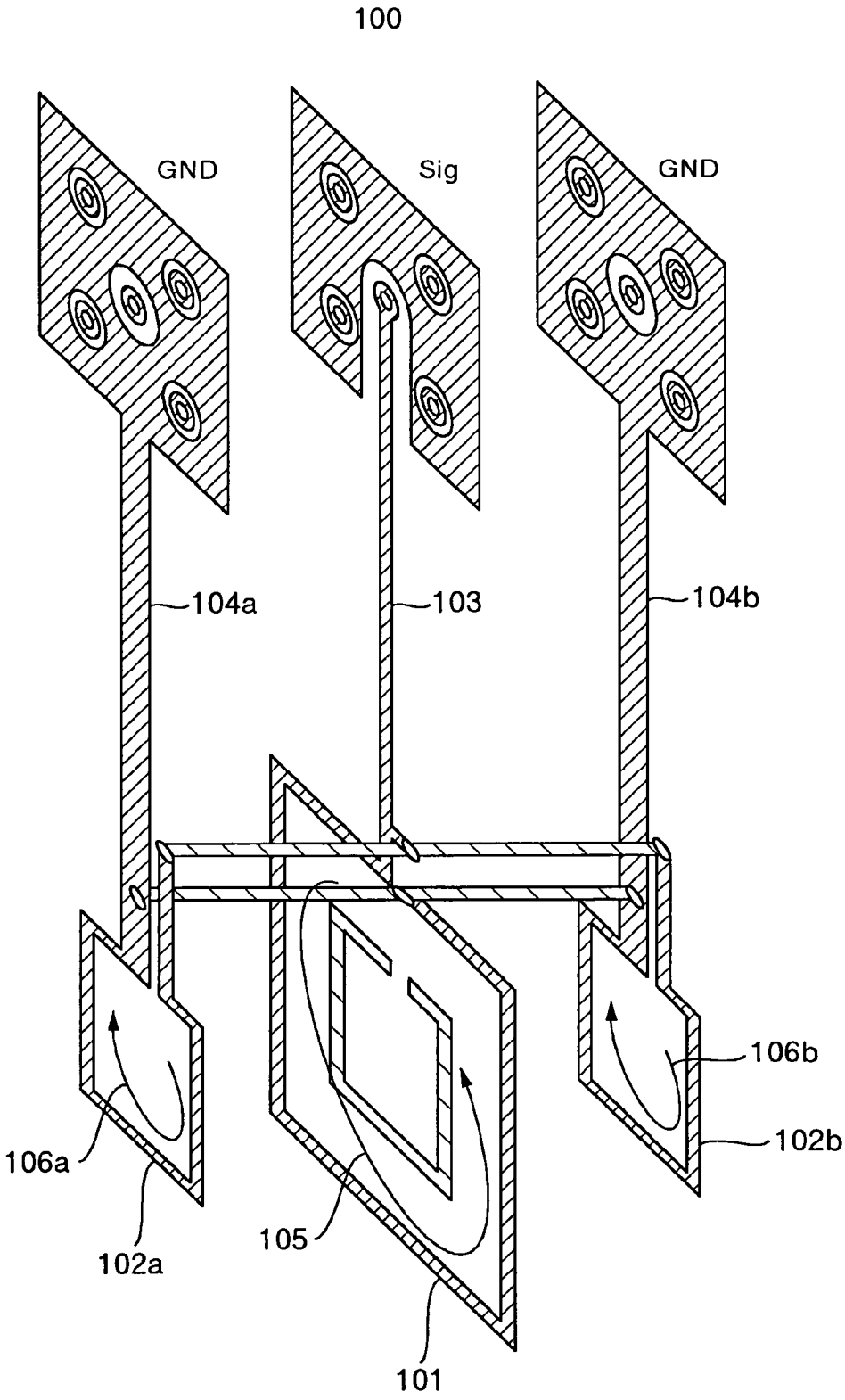
FIG. 1 is a drawing for illustrating a narrow-directivity probe embodiment 1.

Hereinafter, referring to the drawings, the explanation will be given below concerning embodiments of the present invention.

Figure 2:
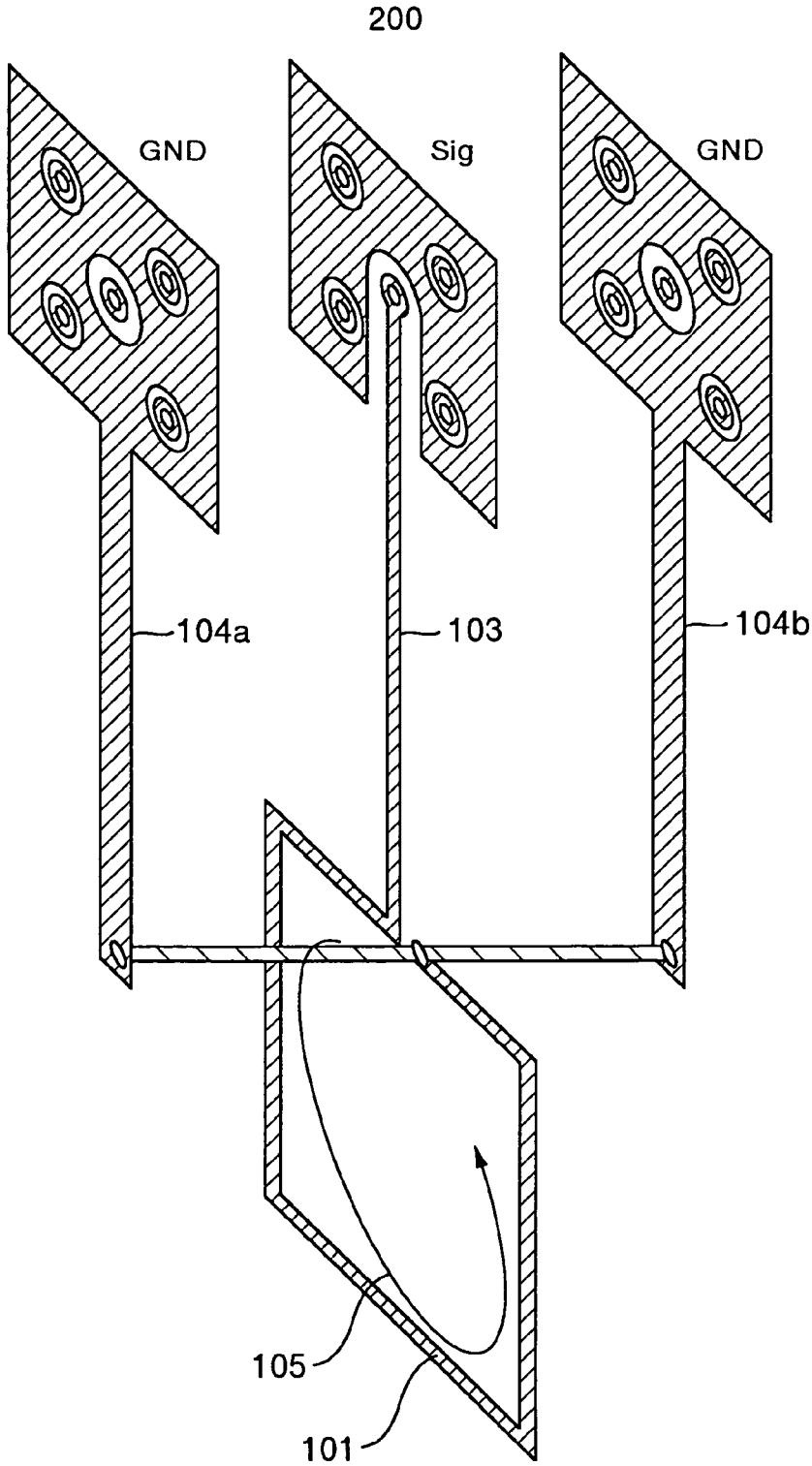
FIG.2 PRIOR ART
FIG. 2 is a drawing for illustrating a conventional-type probe.
Figure 7:
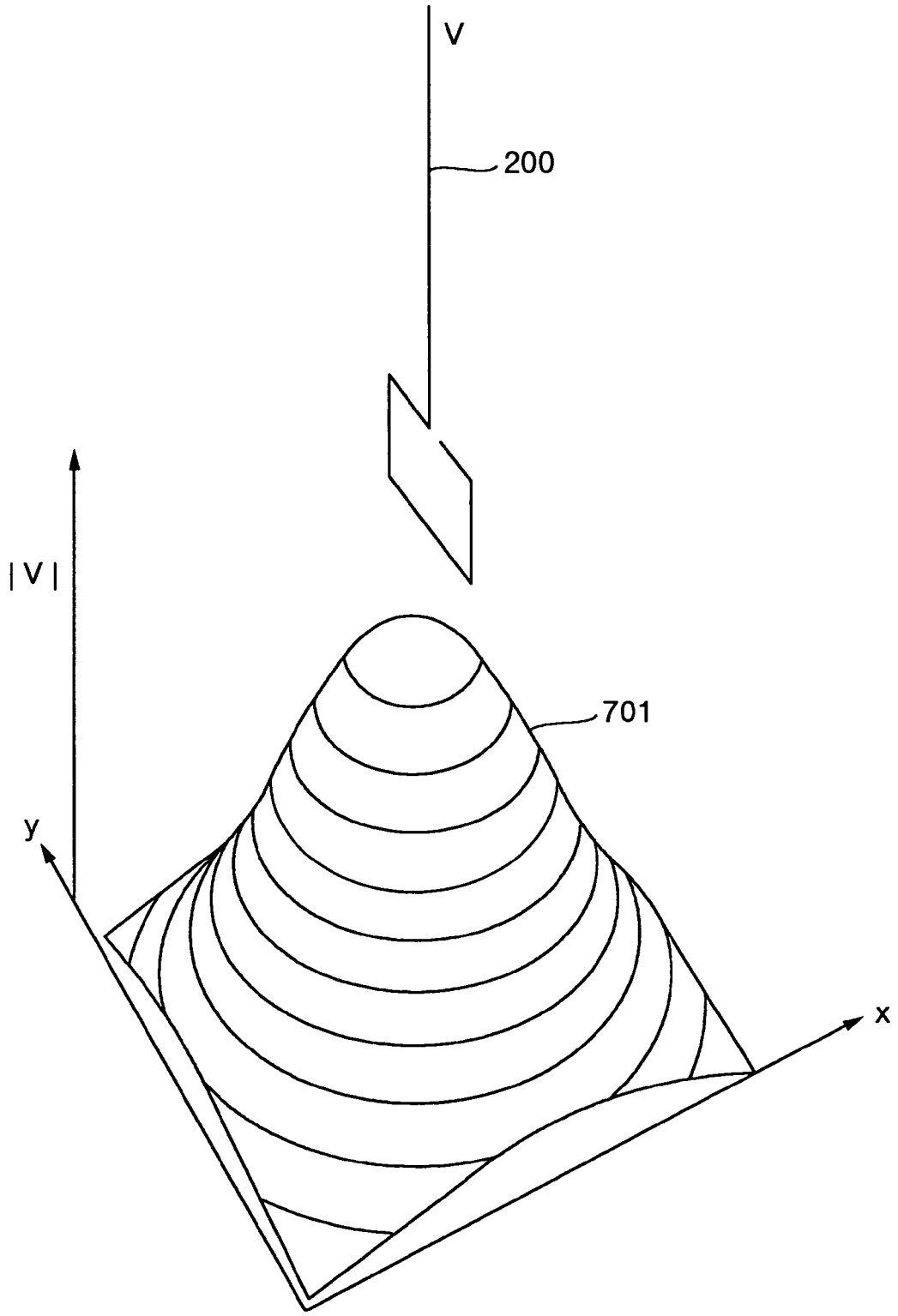
FIG.7 PRIOR ART
FIG. 7 is a drawing for illustrating an in-plane electromagnetic-field intensity distribution generated by the conventional-type probe.

A conventional-type probe 200 illustrated in FIG. 2 extracts a signal line 103, and forms a main probe 101, and is a loop-shaped probe connected to grounds 104. In this shape, as a characteristic of the 1-wound small loop antenna, if, as illustrated in FIG. 7, the probe exists on the yz plane, an in-xy-plane electromagnetic-field intensity distribution 701 generated thereby exhibits a comparatively rolling distribution. On account of this, a region in which this in-xy-plane electromagnetic-field intensity distribution 701 becomes equal to a half-value with respect to the peak thereof, i.e., a position resolution at the time of a measurement, is of substantially the same order as the height of the probe. In view of this situation, in order to narrow this region and enhance the position resolution, a probe having a structure as illustrated in FIG. 1 is proposed.

Figure 8:
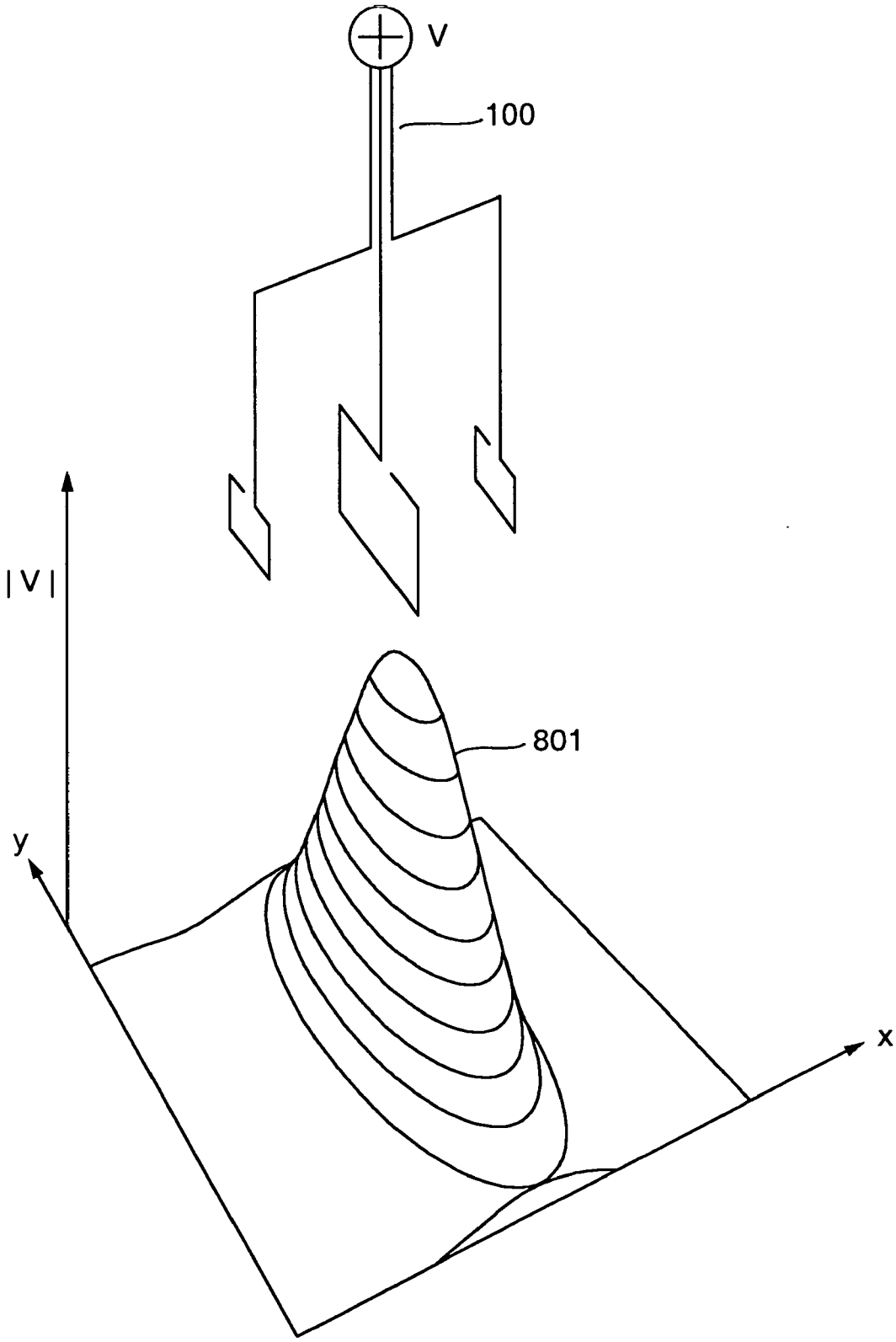
FIG. 8 is a drawing for illustrating an in-plane electromagnetic-field intensity distribution generated by the narrow-directivity probe embodiment 1.

A probe embodiment 1 illustrated in FIG. 1 extracts the signal line 103, and forms the main probe 101, and, as directionality-adjusting devices 102 (102*a*, 102*b*), simultaneously forms loop antennas that are inversely wound with respect to the main probe. Moreover, the respective lines are connected to the grounds 104. At this time, an electric-current path 105 of the main probe 101 and electric-current paths 106 (106*a*, 106*b*) of the directionality-adjusting devices 102 become opposite in their directions. As a result, even if identical-phase electric currents are fed thereto, electromagnetic fields generated thereby become opposite in their phases. On account of this, the electromagnetic fields generated by the directionality-adjusting devices 102 operate such that these electromagnetic fields cancel out the electromagnetic field generated by the main probe 101. If, for example, the summation of the areas of the directionality-adjusting devices 102 is smaller as compared with the area of the main probe 101, as illustrated in FIG. 8, an in-plane electromagnetic-field intensity distribution 801 finally generated becomes narrower as compared with the electromagnetic-field intensity distribution 701 generated by the conventional-type probe. This indicates that a narrow-directivity probe has been implemented.

Figure 3:
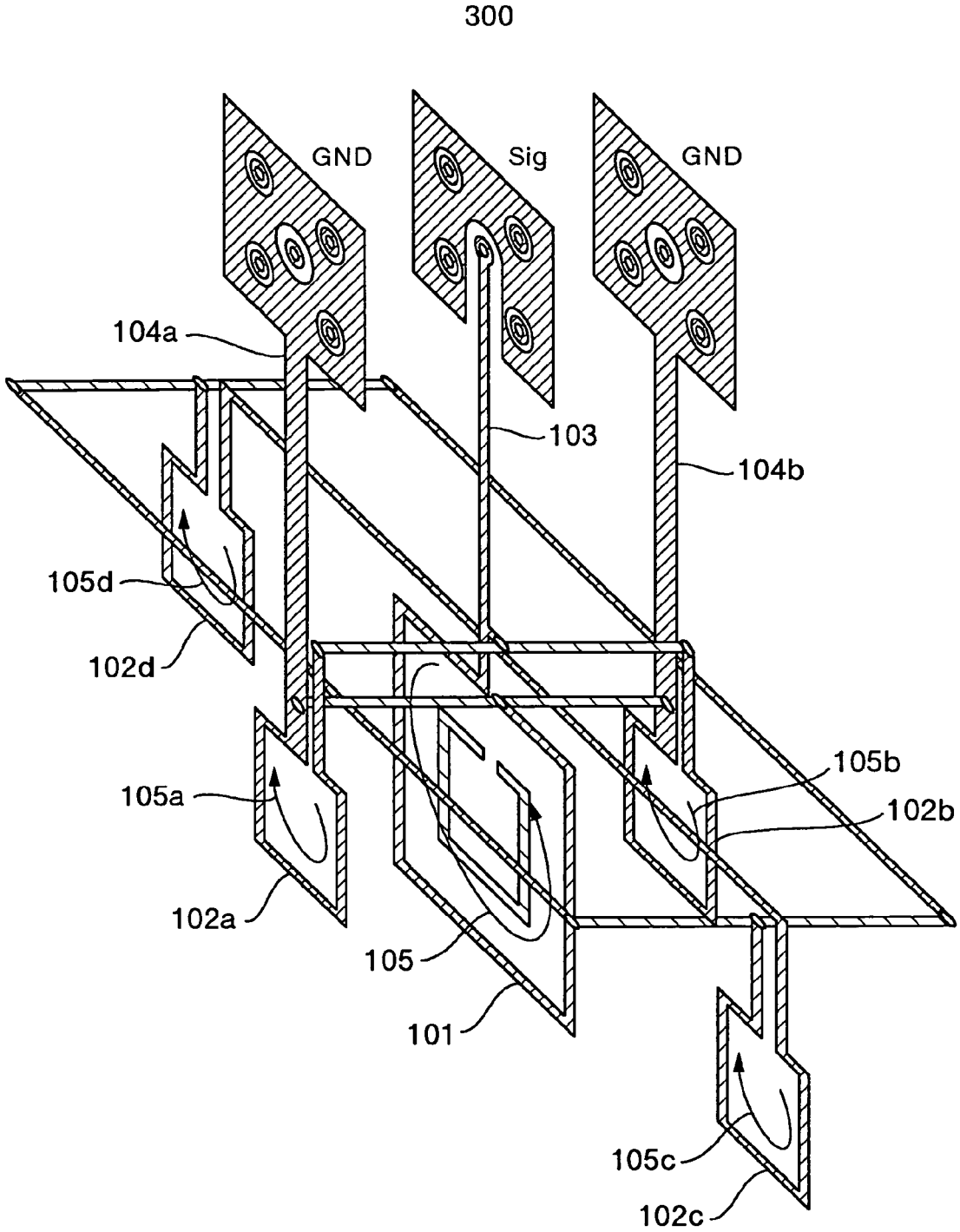
FIG. 3 is a drawing for illustrating a narrow-directivity probe embodiment 2.
Figure 9:
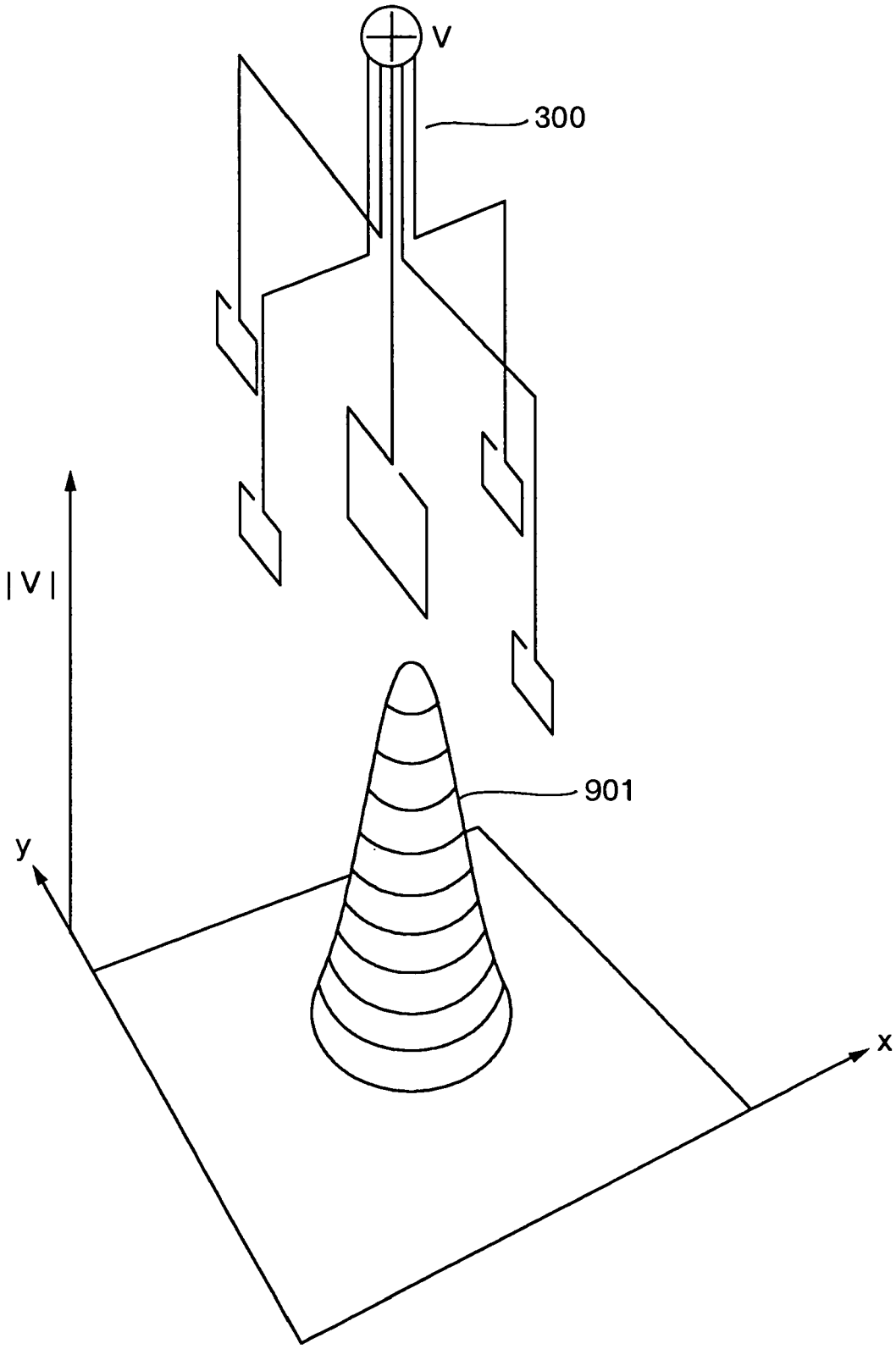
FIG. 9 is a drawing for illustrating an in-plane electromagnetic-field intensity distribution generated by the narrow-directivity probe embodiment 2.

Furthermore, in a probe embodiment 2 illustrated in FIG. 3, the directionality-adjusting devices 102 (102*a*–102*d*) are located in a symmetric manner, i.e., located in the axis direction of the main probe 101 and in the direction perpendicular thereto. As illustrated in FIG. 9, this location implements, from the electromagnetic-field intensity distribution generated by the main probe 101, an electromagnetic-field intensity distribution 901 that is narrower than the electromagnetic-field intensity distribution 801 shown in the probe embodiment 1. This indicates that the probe embodiment 2 has become a narrow-directivity probe.

Figure 4:
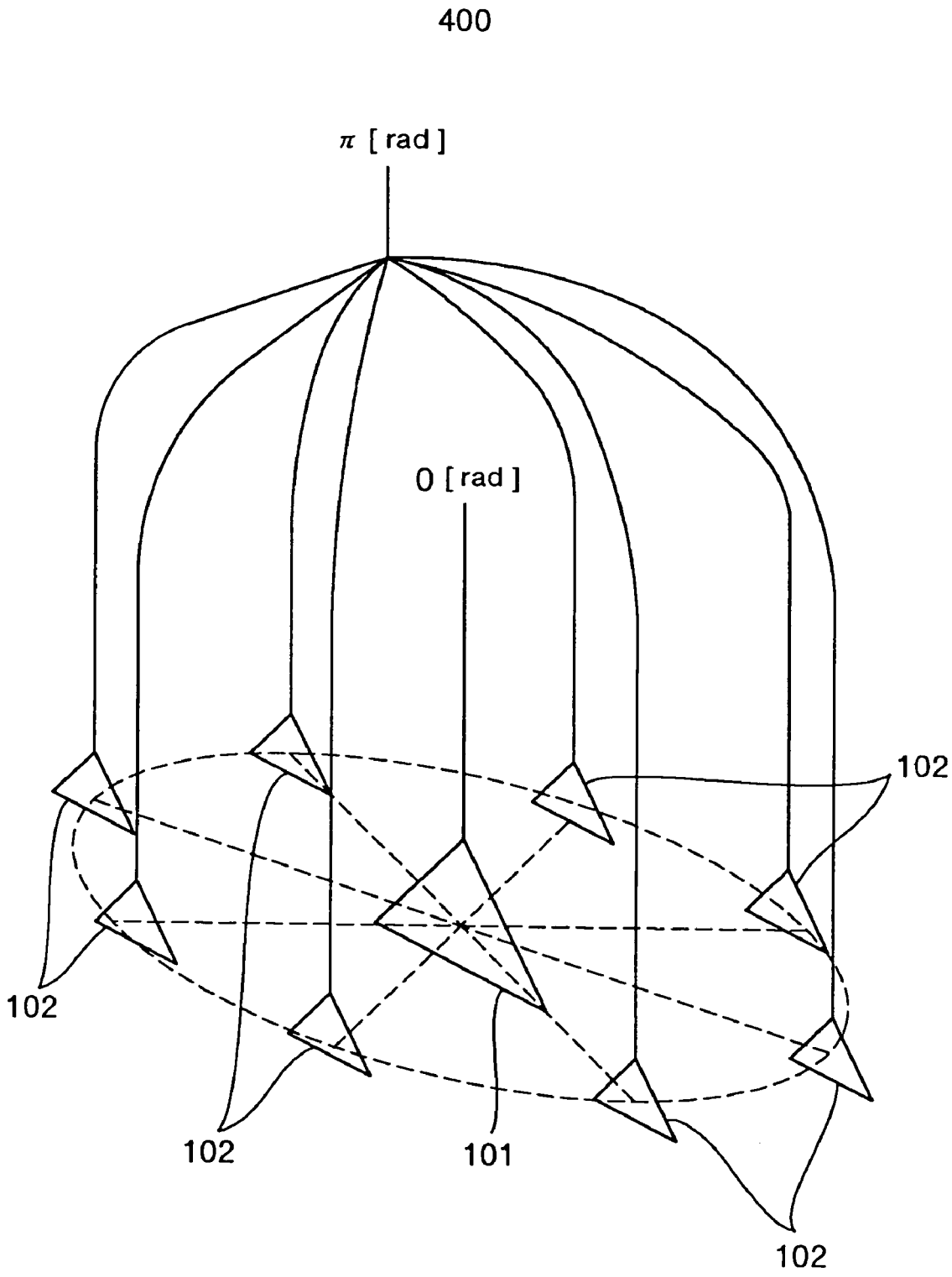
FIG. 4 is a drawing for illustrating a narrow-directivity probe device arrangement 1.

In this way, when the directionality-adjusting devices 102 are located around the main probe 101, the resultant electromagnetic-field intensity distribution can be focused in comparison with the case of the main probe 101 alone. This means that a narrow-directivity probe has been implemented. FIG. 4 illustrates a conceptual diagram thereof. Here, assuming that the electric-current path 105 of the main probe 101 and the electric-current paths 106 of the directionality-adjusting devices 102 are identical in their directions, the fed electric-current phase difference between the main probe 101 and the directionality-adjusting devices 102 located around the main probe 101 is shifted by π[rad]. This allows the directionality-adjusting devices 102 to cancel out the electromagnetic field generated by the main probe 101, thereby making it possible to narrow the directionality. Meanwhile, as the embodiment illustrated in FIG. 1 or FIG. 3, even if the fed electric-currents are identical in their phases, basically the same result can be acquired as long as the electric-current path 105 of the main probe 101 and the electric-current paths 106 of the directionality-adjusting devices 102 are opposite in their directions. Also, when the electric-current path 105 of the main probe 101 and the electric-current paths 106 (106*a*, 106*b*, 106*c*, 106*d*) of the directionality-adjusting devices 102 are identical in their directions, the phase difference therebetween need not be completely equal to π[rad], but is allowable as long as the phase difference falls in the range of π±π/2[rad]. From this condition, when the electric-current path 105 of the main probe 101 and the electric-current paths 106 (106*a*–106*d*) of the directionality-adjusting devices 102 (102*a*–102*d*) are opposite in their directions, the phase difference between the fed electric-currents is allowable up to a phase difference of 0±π/2[rad].

Figure 5:
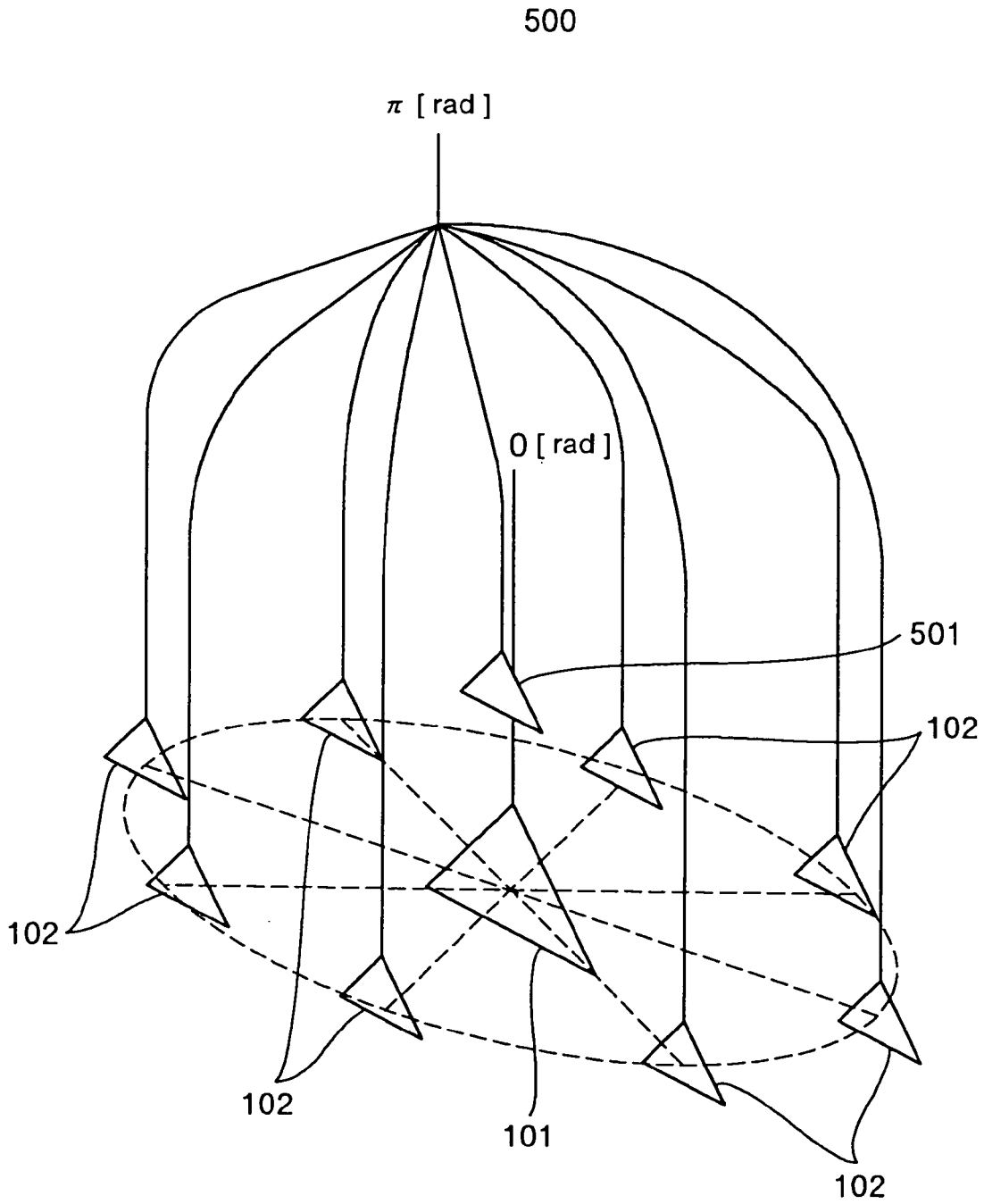
FIG. 5 is a drawing for illustrating a narrow-directivity probe device arrangement 2.

An object of these narrow-directivity probes is to focus the electromagnetic-field intensity distribution in the plane. These narrow-directivity probes, however, are of the symmetric shapes. This condition generates basically the same electromagnetic-field intensity distributions in a direction opposite to the observation plane as well, i.e., in the upward direction in the probe's configuration drawing illustrated in FIG. 4. In contrast thereto, as illustrated in FIG. 5, an adjustment device 501 whose directionality is antisymmetric is located above the main probe 101. This condition allows the probe's directionality to be focused in the observation-plane direction.

Figure 6:
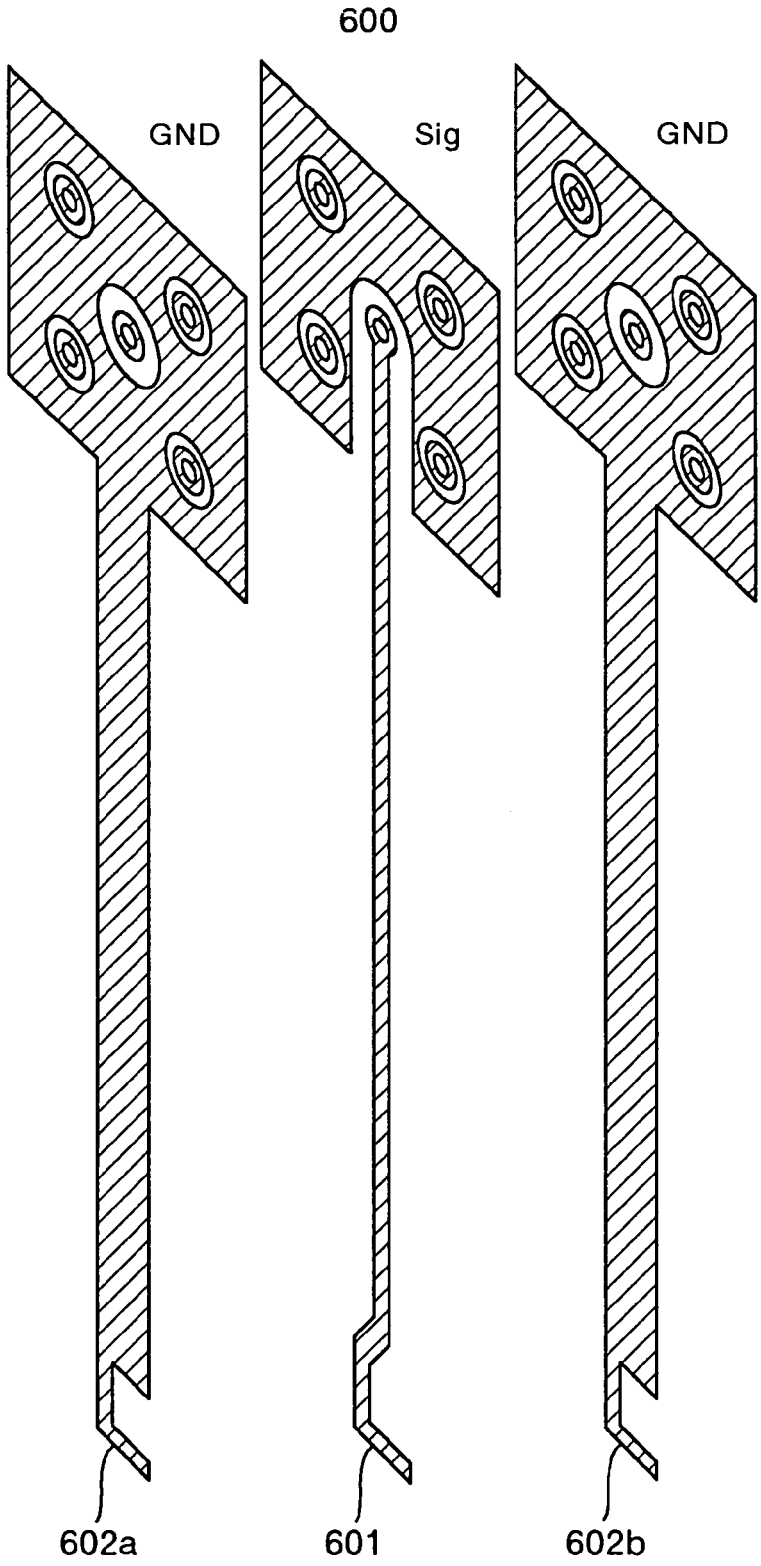
FIG. 6 is a drawing for illustrating an electric-field-type narrow-directivity probe embodiment 1.

In the explanation given so far, the explanation has been given by selecting, as the central subject, the probes for focusing the magnetic-field intensity distribution and by referring to the drawings all of which use the loop antennas. As illustrated in FIG. 6, however, the use of monopole antennas also allows a narrow-directivity probe to be similarly implemented for an electric-field intensity distribution: Namely, directionality-adjusting devices 602 are located such that the devices 602 cancel out the electric-field intensity distribution generated by a main probe 601. In this case as well, as illustrated in FIG. 6, if the electric-current path directions are opposite ones, the phase difference between fed electric-currents is allowable up to the phase difference of 0±π/2[rad]. Also, if the directions of the directionality-adjusting devices 602 are inverted, the phase difference between the fed electric-currents is allowable up to the phase difference of π±π/2 [rad].

Figure 10:
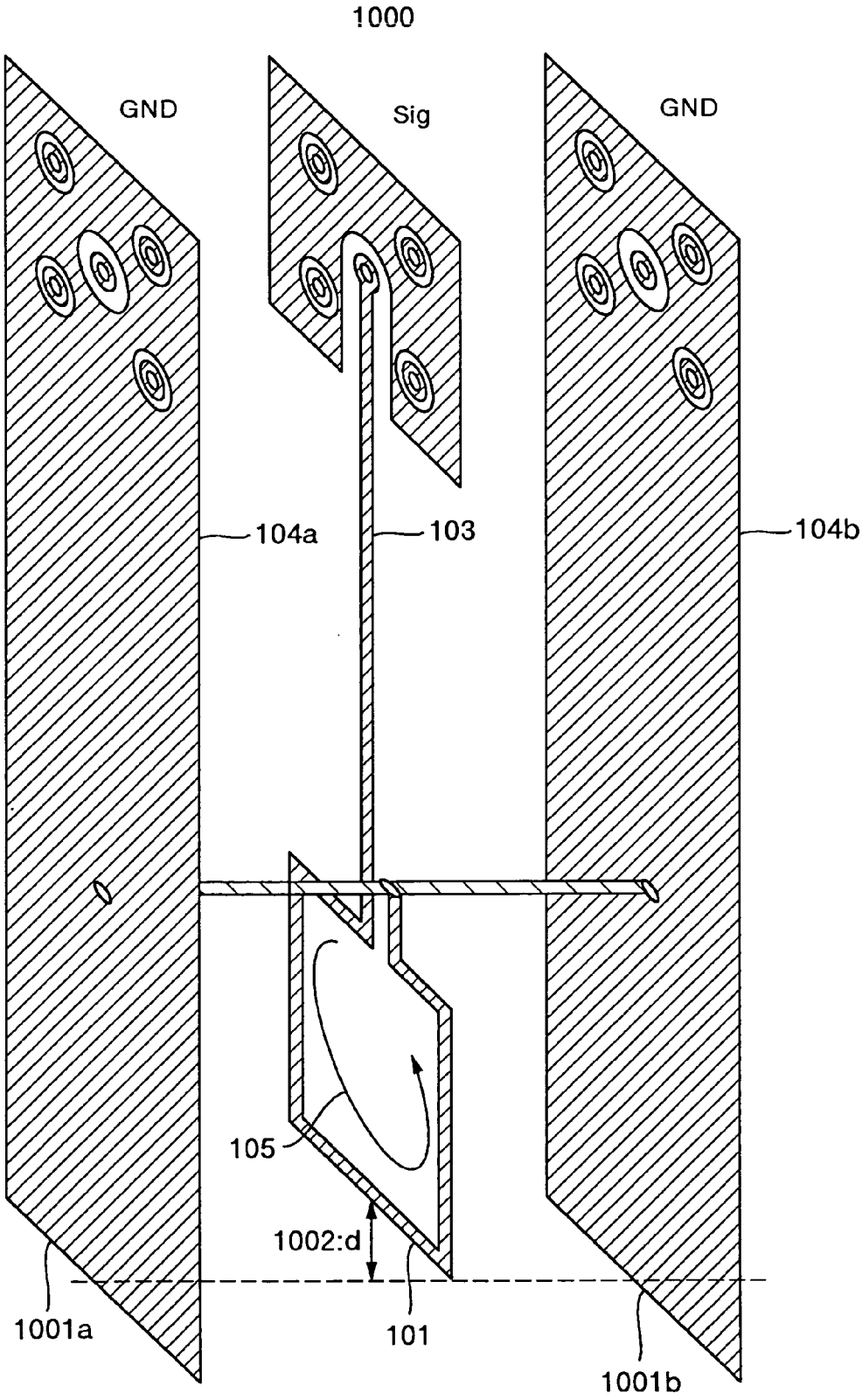
FIG. 10 is a drawing for illustrating a narrow-directivity probe embodiment 3.
Figure 11:
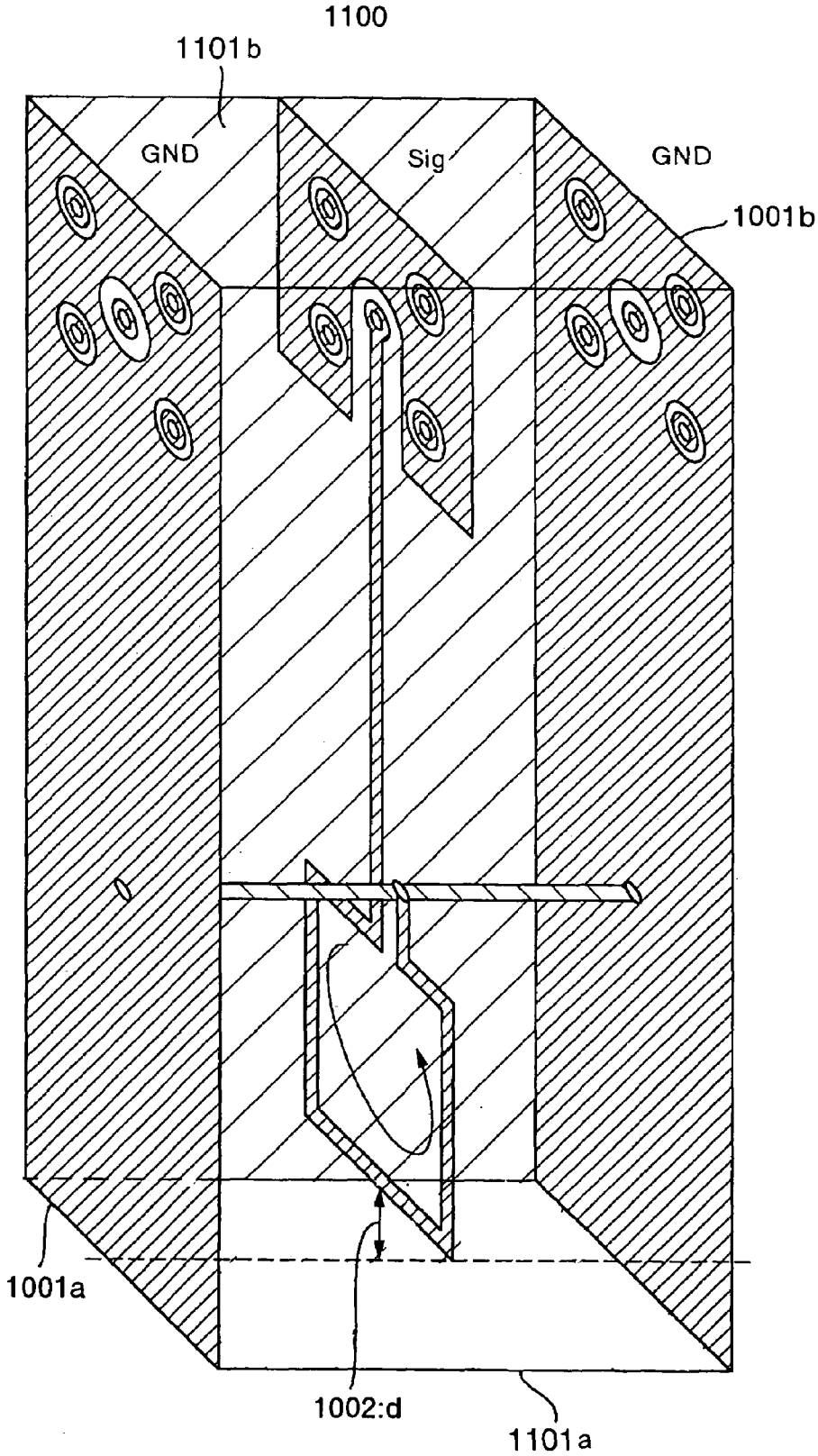
FIG. 11 is a drawing for illustrating a narrow-directivity probe embodiment 4.

Next, referring to FIG. 10 and FIG. 11, the explanation will be given below concerning different embodiments of the configuration mode of the narrow-directivity probe. This configuration is as follows: As illustrated in FIG. 10, in a loop-shaped probe that extracts the signal line 103, and forms the main probe 101, and is connected to the grounds 104, there is provided a method of using conductor plates as the wiring of the grounds 104 to form the conductor plates into directionality-adjusting conductor plates 1001 (1001*a*, 1001*b*). Here, it has been known that, if an infinite conductor flat-plate exists for an electric current, a mirror image is configured at a position that is symmetrical to the plane. In this embodiment, the size of these conductor plates is made finite, thereby forming mirror images in an incomplete manner so as to substitute the directionality-adjusting conductor plates 1001 for the directionality-adjusting devices 102 illustrated in FIG. 1. Here, the condition that the conductor plates 1001 are required to satisfy is as follows: The directionality-adjusting conductor plates 1001 are larger than the main probe 101 so that, if the main probe 101 is projected in the axis direction thereof, the entire main probe 101 can be projected on the plates 1001. This is because the plates 1001, although in the incomplete manner, are required to configure the mirror images. Here, in the narrow-directivity probe embodiment 3 (1000) illustrated in FIG. 10, as is the case with the narrow-directivity probe embodiment 1 (100) illustrated in FIG. 1, an in-plane electromagnetic-field intensity distribution generated thereby becomes basically the same as the in-plane electromagnetic-field intensity distribution 801 illustrated in FIG. 8. In view of this situation, as illustrated in FIG. 11, these directionality-adjusting conductor plates 1001 (1001*a*, 1001*b*) are connected to each other and directionality-adjusting conductor plates 1101*a* and 1101*b* are provided on a probe side, thereby configuring a rectangular-parallelepiped shape. This configuration allows the directionality-adjusting conductor plates 1001 and 1101 to be substituted for the directionality-adjusting devices 102 illustrated in FIG. 3, with 1002:d indicating a distance between a main probe end and a directionality-adjusting condition plate end. Accordingly, in this narrow-directivity probe embodiment 4 (1100), as is the case with the narrow-directivity probe embodiment 2 (300) illustrated in FIG. 3, an in-plane electromagnetic-field intensity distribution generated thereby becomes basically the same as the in-plane electromagnetic-field intensity distribution 901 illustrated in FIG. 9. In this way, the utilization of the mirror-image effect makes it possible to cause the directionality-adjusting conductor plates 1001 to play a role of the directionality-adjusting devices 102. As the shape of the directionality-adjusting conductor plates 1001 in this case, in addition to the parallel flat-plates shape in FIG. 10 and the rectangular-parallelepiped shape in FIG. 11, various configurations such as a cylindrical shape are available. The condition for permitting the conductor plates 1001 to be substituted for the directionality-adjusting devices 102 is that the conductor plates 1001 have enough areas for permitting the main probe 101 to be projected in at least two directions.

The methods explained so far make it possible to configure the narrow-directivity probes. However, in the case of a configuration of having the maximum sensitivity in the front-side direction of the main probe 101, the following conditions are necessary: The directionality-adjusting devices 102 or the directionality-adjusting conductor plates 1001 are located at positions that are symmetrical to each other with respect to the main probe 101. Moreover, in order that each of the located directionality-adjusting device 102 or directionality-adjusting conductor plate 1001 will generate an electromagnetic field of the same magnitude, electric currents of the same magnitude are caused to flow in the devices 102 or the conductor plates 1001 which are in the above-described position-symmetry relationship, or the products of these electric currents are equal to each other, or the like.

Figure 14:
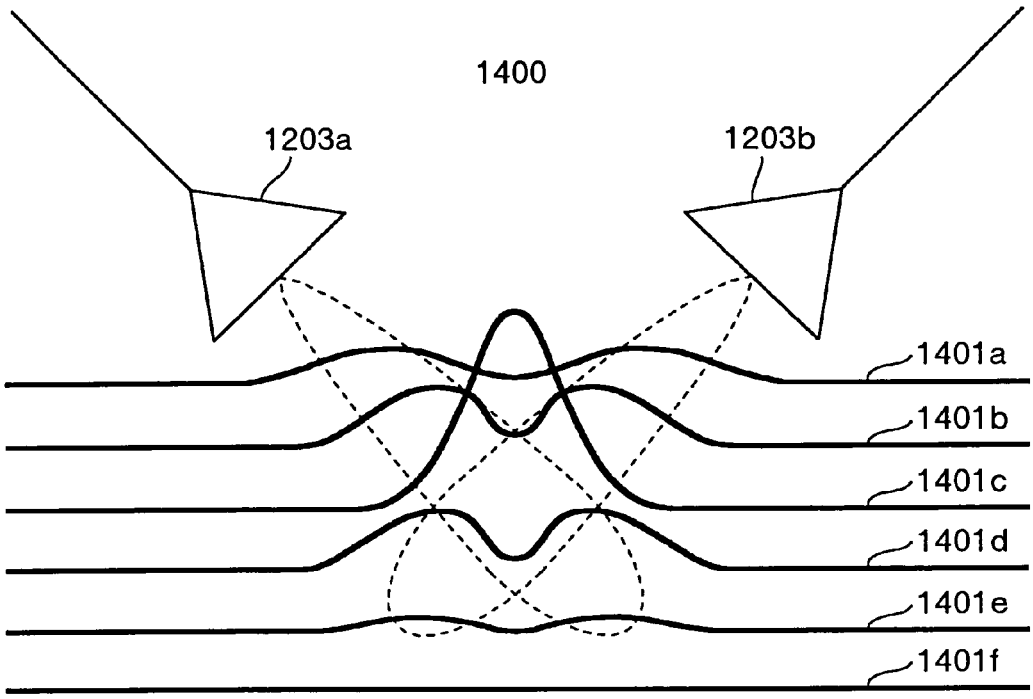
FIG. 14 is a drawing for illustrating a pin-point electromagnetic-field generation mechanism embodiment 1 by a narrow-directivity probe array.
Figure 15:
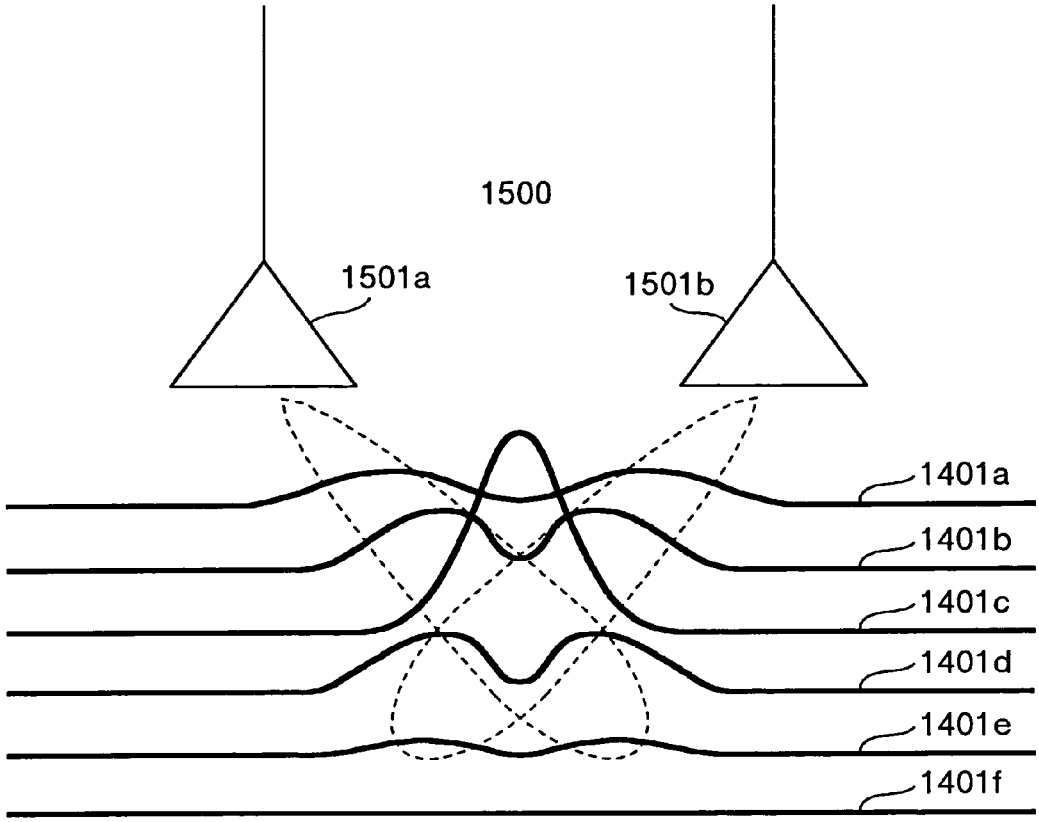
FIG. 15 is a drawing for illustrating a pin-point electromagnetic-field generation mechanism embodiment 2 by the narrow-directivity probe array.

In this case, however, the maximum sensitivity always exists on a line in the maximum-sensitivity direction. This condition results in the following problems: If an obstructing object exists halfway on the way to a target to be measured, it is impossible to perform the irradiation with an electromagnetic field in this direction here. Otherwise, if electromagnetic-wave sources exist, it is impossible to observe a desired electromagnetic-wave source. In view of this situation, as illustrated in FIG. 14, a plurality of narrow-directivity probes are prepared, and are located such that their maximum-sensitivity directions intersect with each other at a certain single point. As the result of this location, layer-basis in-plane electromagnetic-field intensity distributions 1401 in correspondence with distances from the plurality of probes have the maximum sensitivities at the point of the intersection. This allows the implementation of the electromagnetic-field irradiation at a pin point, or that of the observation of an electromagnetic-wave source.

Here, in FIG. 14, each of the narrow-directivity probes has been oriented to the desired position at which each of the maximum sensitivities is wished to be acquired. Tilting the maximum-sensitivity directions of the narrow-directivity probes, however, makes it possible to implement a configuration where the maximum-sensitivity directions are oriented to a desired single point although, seemingly, the narrow-directivity probes are arranged within a certain plane. This tilting is implemented by reducing the sizes or the electric currents of the directionality-adjusting devices 102 or directionality-adjusting conductor plates 1001 located such that each maximum-sensitivity direction of each narrow-directivity probe is oriented to the desired direction. Otherwise, this tilting is implemented by reducing both the sizes and the electric currents. Furthermore, even if the sizes or the electric currents of the directionality-adjusting devices 102 or directionality-adjusting conductor plates 1001 are equal to each other, shifting the phases of the fed electric-currents allows the maximum-sensitivity directions to be tiled in the desired direction.

This makes it possible to configure a probe system having its maximum sensitivity at a 3-dimensionally desired position that is not limited within a plane.

Figure 12:
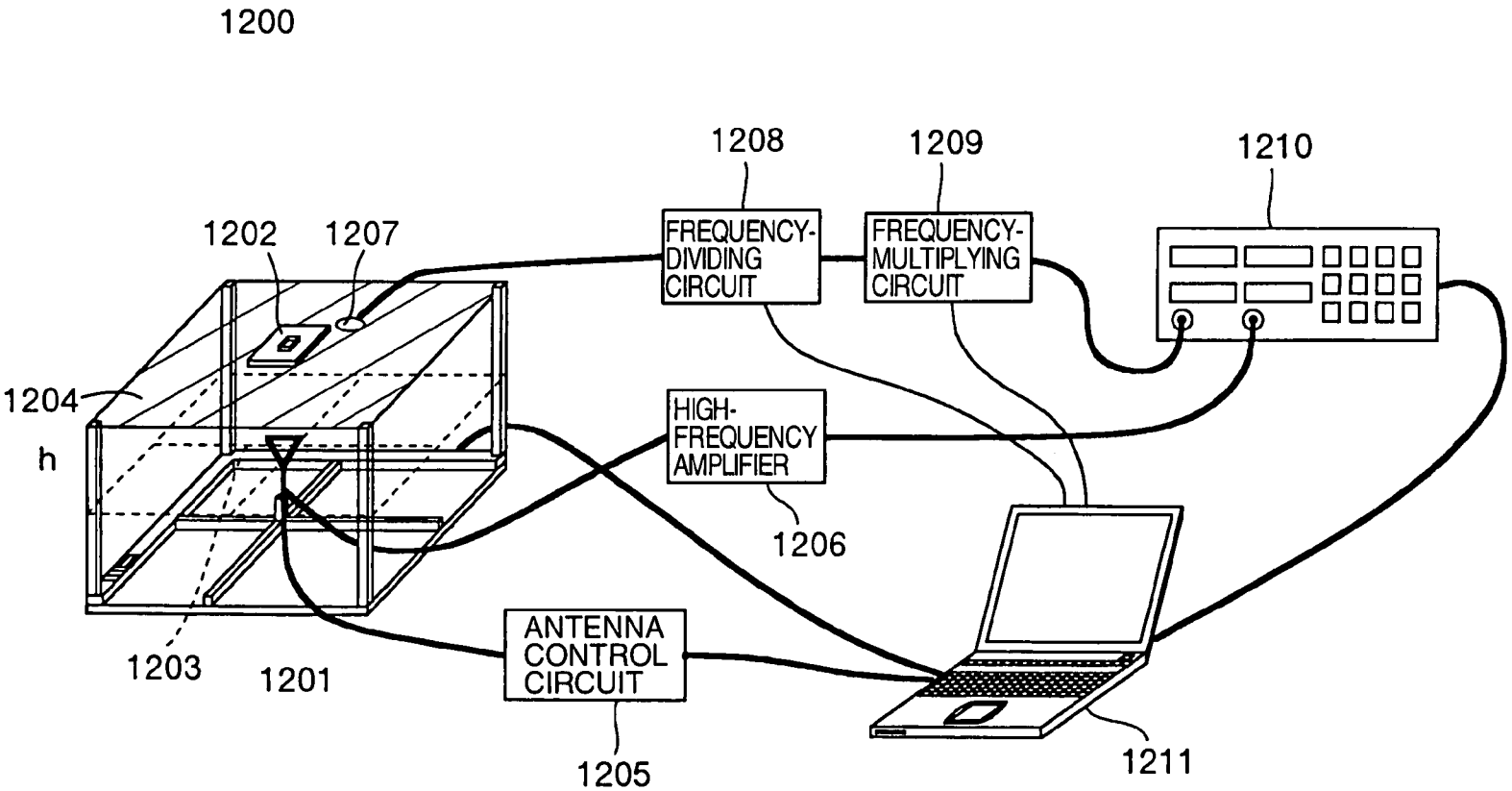
FIG. 12 is a drawing for illustrating an electromagnetic-field distribution measurement/electric-current distribution search apparatus.

The narrow-directivity probe 1203 explained so far is applicable to an apparatus. 1200 illustrated in FIG. 12. The apparatus 1200 measures the electromagnetic-field distribution of an electronic appliance or the like, or searches for the electric-current distribution thereof from its result. This apparatus 1200 is configured by mounting the narrow-directivity probe 1203 on a 2/3/4-dimensional stage. The apparatus 1200 scans the proximity to a to-be-measured target 1202, then measuring the distribution of the proximate magnetic field and/or electric field Here, the apparatus 1200 has an antenna control circuit 1205 that includes a switch used as follows: In order to perform the rough measurement at first, and then in order to perform the detailed measurement of a location where the electric-field or magnetic-field component is intense or the like, the switch is used at first for cutting off the directionality-adjusting devices 102 of the narrow-directivity probe 1203 to transform the narrow-directivity probe into a common probe, and, at the time of the detailed measurement, the switch is used for transforming the common probe back to the narrow-directivity probe. This antenna control circuit 1205 is controlled using a computer 1211 or the like. Also, a signal induced by the probe 1203, depending on its intensity, is caused to pass through a high-frequency amplifier 1206, then being measured by a measurement device 1210. At this time, in order to measure the phase component of this electromagnetic field as well, the following measurement steps are executed: The fundamental clock of the to-be-measured target 1202 is detected using a probe 1207 for detecting the fundamental clock of the to-be-measured target 1202. Next, this signal is caused to pass through a frequency-dividing circuit 1208 and a frequency-multiplying circuit 1209 controlled using the computer 1211 or the like, thereby being converted into a desired frequency component. Moreover, the synchronous detection with this desired frequency component is performed using the detected fundamental clock, thereby making it possible to measure the above-described phase component.

Figure 13:
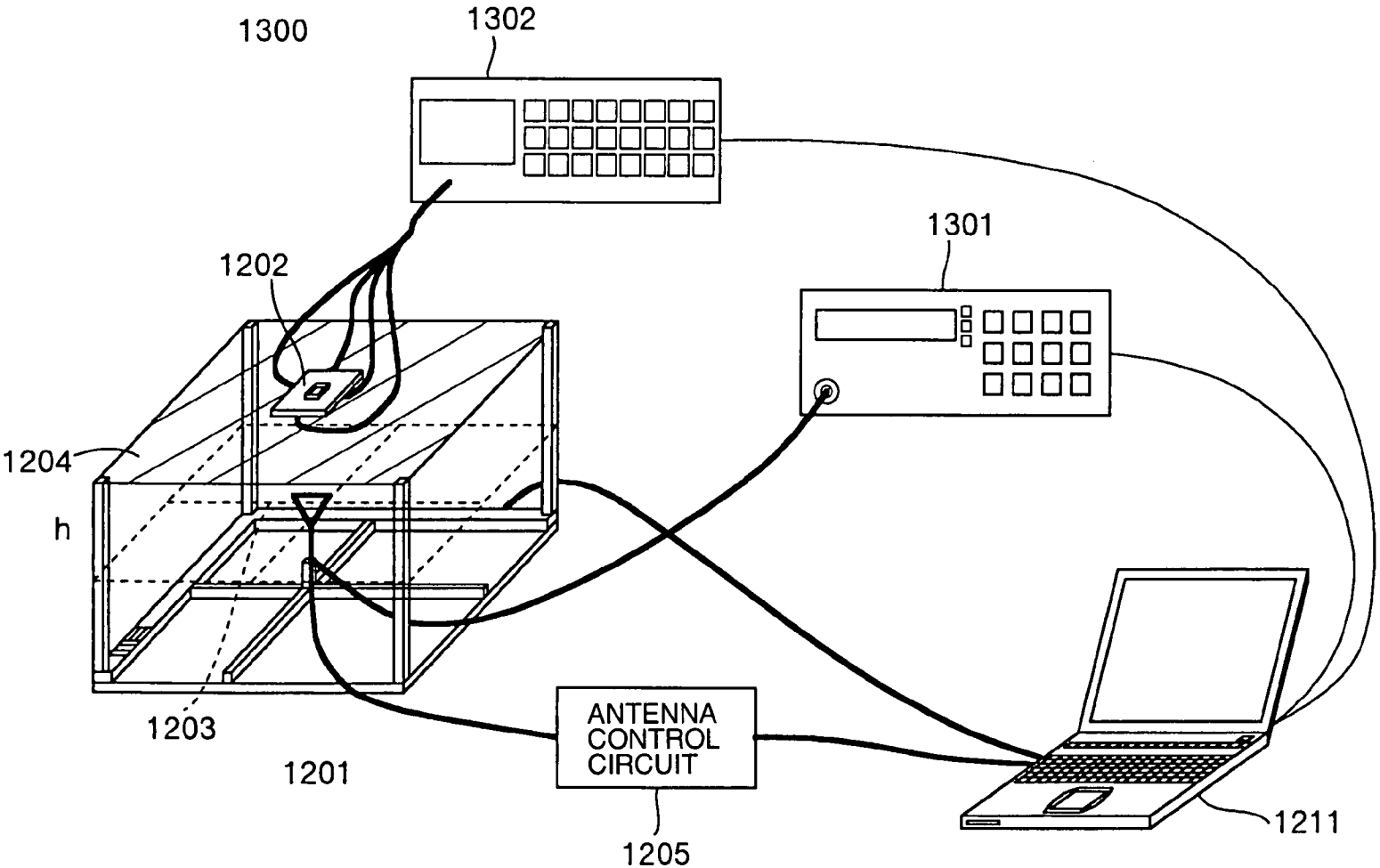
FIG. 13 is a drawing for illustrating an electromagnetic-field irradiation-type inspection apparatus.

Also, the narrow-directivity probe 1203 is applicable to a test apparatus 1300 illustrated in FIG. 13. The test apparatus 1300, which is a test apparatus of an electronic appliance or the like, irradiates the electronic appliance or the like with an electromagnetic field. The apparatus 1300 is configured by mounting the narrow-directivity probe 1203 on the 2/3/4-dimensional stage. The apparatus 1300 scans the proximity to the to-be-tested target 1202, then irradiating the to-be-tested target 1202 with an electromagnetic field from the proximity thereto. The narrow-directivity probe 1203 receives electric-power supply from a signal oscillator 1301, then irradiating a desired position on the to-be-tested target 1202 with the electromagnetic field. Here, as is the case with the apparatus 1200 for measuring the above-described electromagnetic-field distribution or searching for the electric-current distribution thereof from its result, the test apparatus 1300 has the antenna control circuit 1205 that includes a switch used as follows: In order to perform the rough irradiation at first, and then in order to make the detailed test after identifying the region of location in question, the switch is used at first for cutting off the directionality-adjusting devices 102 of the narrow-directivity probe 1203 to transform the narrow-directivity probe into the common probe, and, at the time of the detailed test, the switch is used for connecting the directionality-adjusting devices 102 thereto to transform the common probe back to the narrow-directivity probe. This antenna control circuit 1205 is controlled using the computer 1211 or the like. Here, the operation state of the to-be-tested target 1202 such as the electronic appliance at the time of irradiating the to-be-tested target with the electromagnetic field is inspected by a tester or a measurement device 1302 controlled using the computer 1211 or the like. Moreover, its result is inputted into the computer 1211 or the like so as to make the test judgment.

In the apparatus for measuring the electric-field and/or magnetic-field distribution generated by an electronic appliance or the like, and for searching for the electric-current distribution of the electronic appliance or the like from its result, or in the test apparatus or the like for irradiating an electronic appliance or the like with an electric field and/or a magnetic field, and for observing the reaction from the electronic appliance or the like caused by this irradiation, there is provided a probe whose directionality is narrower as compared with the directionality of the conventional probe. This makes it possible to provide the measurement/test apparatus exhibiting a tremendously high position resolution.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A narrow-directivity antenna probe for performing the measurement of or the irradiation with an electric field or a magnetic field, comprising:

a main antenna probe for performing said measurement of or said irradiation with said electric field or said magnetic field; and at least two or more directionality-adjusting antenna probes located in proximity to said main antenna probe in order to narrow the directionality of said main antenna probe;

wherein said directionality-adjusting antenna probes are fed with opposite-phase electric currents with respect to the phase of the electric current fed to said main antenna probe, and a phase difference between the phase of the electric current fed to said main antenna probe and a phase of the opposite-phase electric currents fed to said directionality-adjusting antenna probes is in a range of $\pi \pm \pi/2$[rad].

2. The narrow-directivity antenna probe according to claim 1, wherein said directionality-adjusting antenna probes are located in proximity to said main antenna probe in a symmetric arrangement.

3. The narrow-directivity antenna probe according to claim 1, wherein a supply electric-power to said directionality-adjusting antenna probes is made smaller than a supply electric-power to said main antenna probe, or a reception electric-power of said directionality-adjusting antenna probes is attenuated and superimposed on a reception signal of said main antenna probe, or the size of said directionality-adjusting antenna probes is made smaller than that of said main antenna probe, said directionality-adjusting antenna probes being located in order to narrow said directionality of said main antenna probe for performing said measurement of or said irradiation with said electric field or said magnetic field.

4. The narrow-directivity antenna probe according to claim 1, wherein an electromagnetic field generated by said directionality-adjusting antenna probes has a phase difference of $\pi \pm \pi/2$[rad] with respect to an electromagnetic field generated by said main antenna probe, said directionality-adjusting antenna probes being located in order to narrow said directionality of said main antenna probe for performing said measurement of or said irradiation with said electric field or said magnetic field.

5. A narrow-directivity antenna probe system for using said narrow-directivity antenna probe according to claim 1 in plural number so as to isolate and observe electromagnetic fields from wave sources existing in a desired spacious region, or so as to superimpose electromagnetic fields on each other in a desired spacious region thereby to generate an electromagnetic field that is more intense than said electromagnetic field generated in the case of said single narrow-directivity antenna probe.

6. An electromagnetic-field measurement apparatus for using said narrow-directivity antenna probe according to claim 1 so as to measure the proximate electric-field or magnetic-field distribution in proximity to an electronic appliance or the like.

7. An electric-current distribution search-for apparatus for using said narrow-directivity antenna probe according to claim 1 so as to measure the proximate electric-field or magnetic-field distribution in proximity to an electronic appliance or the like, and for determining said electric-current distribution by calculation from a result of said measurement.

8. An electrical-wiring diagnosis apparatus for using said narrow-directivity antenna probe according to claim 1 so as to irradiate an electronic appliance or the like with an electric field or a magnetic field, and for detecting a signal thereby to check the electrical-wiring connection state of said electronic appliance or the like, said signal being generated at a terminal of said electronic appliance or the like by an electric voltage or an electric current induced by said electric field or said magnetic field.

* * * * *